US005726121A

United States Patent [19]

Uemura et al.

[11] Patent Number: 5,726,121

[45] Date of Patent: Mar. 10, 1998

[54] IMAGE RECEIVING SHEET FOR SUBLIMATION TRANSFER

[75] Inventors: Hiroyuki Uemura, Mishima; Chiharu Nogawa, Shizuoka-ken, both of Japan

[73] Assignee: Ricoh Company, Ltd., Tokyo, Japan

[21] Appl. No.: 714,816

[22] Filed: Sep. 17, 1996

Related U.S. Application Data

[62] Division of Ser. No. 360,093, Dec. 20, 1994, Pat. No. 5,597,774.

[30] Foreign Application Priority Data

Dec. 21, 1993 [JP] Japan ..... 5-322751

[51] Int. Cl.[6] ..... B41M 5/035; B41M 5/38

[52] U.S. Cl. ..... 503/227; 428/195; 428/447; 428/913; 428/914

[58] Field of Search ..... 8/471; 428/195, 428/447, 913, 914; 503/227

[56] References Cited

U.S. PATENT DOCUMENTS 4,880,768 11/1989 Mochizuki et al. .
4,985,397 1/1991 Uemura et al. .
5,019,550 5/1991 Suzuki et al. .
5,049,538 9/1991 Mochizuki et al. .
5,106,816 4/1992 Morohoshi et al. .
5,144,334 9/1992 Suzuki et al. .
5,286,706 2/1994 Mochizuki et al. .
5,314,861 5/1994 Morohoshi et al. .
5,348,931 9/1994 Mochizuki et al. .
5,376,619 12/1994 Mochizuki et al. .
5,472,931 12/1995 Morohoshi et al. .
5,525,573 6/1996 Uemura et al. .
5,547,915 8/1996 Suzuki et al. .

*Primary Examiner*—Bruce H. Hess
*Attorney, Agent, or Firm*—Oblon, Spivak, McClelland, Maier & Neustadt, P.C.

[57] ABSTRACT

An image receiving sheet for sublimation transfer has a dye receiving layer formed on a substrate directly or through an intermediate layer. This dye receiving layer is mainly constructed by hardened resin. Further, a gel fraction of the dye receiving layer is equal to or greater than 70% by weight. In accordance with this construction, it is possible to improve a surface release property of the image receiving sheet used in combination with a thermally sublimating transfer recording medium. Further, when this image receiving sheet is applied to n-fold mode recording process, no image receiving sheet is stuck to a dye layer of recording medium.

15 Claims, No Drawings

IMAGE RECEIVING SHEET FOR SUBLIMATION TRANSFER

This is a Division of application Ser. No. 08/360,093 filed on Dec. 20, 1994, now U.S. Pat. No. 5,597,774.

BACKGROUND OF THE INVENTION

The present invention relates to an image receiving sheet for sublimation transfer used in combination with a thermal sublimation transfer recording medium.

Recently, a demand for a full color printer has been increasing. A recording system of the full color printer includes an electrophotographic system, an ink jet system, and a thermal transfer system. The thermal transfer system attracts public attention because of easy maintenance and low noise.

The thermal transfer system is used in either melting transfer recording or sublimating transfer recording. In the melting transfer recording, an image receiving sheet is superimposed on a recording medium having a transfer layer in which a coloring agent is dispersed into a thermally melting substance. Heat is then applied imagewise to the recording medium to melt the transfer layer. Thus, an image is transferred and recorded onto the image receiving sheet.

In the sublimating transfer recording, an image receiving sheet is superimposed on a recording medium having a transfer layer containing a thermally sublimating dye or a thermally transferring dye, which will be simply referred to as a sublimating dye herein. Heat is then applied imagewise to the recording medium so that the dye of the transfer layer is sublimated and transferred onto the image receiving sheet. Thus, an image is recorded on the image receiving sheet.

When a full color image is recorded, the sublimating transfer recording is generally superior to the melting transfer recording in view of fidelity of color tone.

In the conventional sublimating transfer recording, an image receiving sheet has been used which comprises a substrate, such as a paper sheet, a synthetic paper sheet or a synthetic resin film, and a dye receiving layer formed thereon from e.g. a thermoplastic polyester resin showing strong dyeing affinity to a sublimating dye.

However, the conventional image receiving sheet has a release property insufficient to be peeled from the surface of a recording medium. In particular, when the image receiving sheet is used in a so-called n-fold mode recording method, in which an image is recorded onto the image receiving sheet by setting the running speed of the image receiving sheet to a value n-times (n>1) the running speed of a recording medium while the image receiving sheet is superimposed on the recording medium, strong frictional force may be caused between the image receiving sheet and the recording medium resulting in fusion of the sheet and medium or fracture of the sheet.

SUMMARY OF THE INVENTION

It is therefore a main object of the present invention to provide an image receiving sheet for sublimation transfer having high release property.

In the present invention, an image receiving sheet for sublimation transfer has a dye receiving layer formed on a substrate directly or through an intermediate layer, wherein the dye receiving layer contains therein both an unmodified silicone oil and a modified silicone oil.

In accordance with this construction, the image receiving sheet has improved surface release property when used in combination with a thermally sublimating transfer recording medium. Further, when this image receiving sheet is applied to n-fold mode recording, no fusion is caused between the image receiving sheet and a dye layer of the recording medium.

Further objects and advantages of the present invention will be apparent from the following description of the preferred embodiments of the present invention.

DESCRIPTION OF THE PREFERRED EMBODIMENTS

The present invention provides an image receiving sheet for sublimation transfer comprising a dye receiving layer formed on a substrate directly or through an intermediate layer, wherein the dye receiving layer contains both an unmodified silicone oil and a modified silicone oil.

The unmodified silicone oil which may be used herein includes dimethyl silicone oil, methyl phenyl silicone oil and methyl hydrogen silicone oil. The unmodified silicone oil has preferably a kinematic viscosity in the range of 500 to 2,000 centistokes (cs) at 20° C. If an unmodified silicone oil having a kinematic viscosity lower than 500 cs is used, irregularity or unevenness in a coating may be often caused when a dye receiving layer containing the oil is applied on a substrate. On the other hand, if an unmodified silicone oil has a kinematic viscosity higher than 2,000 cs, the improving effect on the slipperiness of the surface of a dye receiving layer tends to reduce.

The modified silicone oil used in the present invention may be derived from such an unmodified silicone oil by modification thereof with a modifier, such as an alcohol, polyether, carboxyl group-containing compound, epoxy group-containing compound, alkyl group-containing compound, fluorine-containing compound, amino group-containing compound, phenolic compound or mercapto compound. Among these modified materials, preferred are those having a modifier moiety which is polar and/or capable of forming a hydrogen bond, such as alcohol-, polyether-, carboxyl- and epoxy-modified silicone oils. In this context, the term "carboxyl group-containing compound" means those compounds having a carboxylic acid group or its derivative group such as a salt or ester. The alcohol modified silicone oil is especially preferred since it provides a high release property and a recorded image hardly blots or spreads during its storage.

The image receiving sheet of the present invention has a good release property due to the combined use of an unmodified and modified silicone oils. The reasons therefor may be as follows: An unmodified silicone oil has low compatibility with a resin, which constitutes a dye receiving layer and has a good dyeing affinity, and tends to migrate to the surface of the dye receiving layer. However, the unmodified silicone oil has no modifying moieties and therefore is symmetrical in the molecular structure and the molecules are not oriented in the dye receiving layer. Accordingly, there is only a small number of hydrophobic methyl groups existing on the surface of the dye receiving layer. In contrast to this, the modified silicone oil having a modifying group is oriented such that many hydrophobic methyl groups exist on the surface of the dye receiving layer. However, compatibility of the modified silicone oil with respect to the resin is high so that the modified silicone oil does not migrate to or is not concentrated on the surface portion of the dye receiving layer.

The number of hydrophobic methyl groups existing on the surface of the dye receiving layer is increased by using the above two kinds of silicone oils. For this reason, it is believed that the image receiving sheet has an excellent release property which cannot be independently obtained by each of these silicone oils.

The ratio of the unmodified silicone oil to the modified silicone oil depends on the nature of modifying groups and/or resins having a good dyeing affinity. Generally, the weight ratio of the unmodified to modified silicone oil ranges from 0.05:0.95 to 0.95:0.05, preferably from 0.20:0.80 to 0.80:0.20.

The total amount of the silicone oils added to the resin of the dye receiving layer is preferably from 2 to 15% by weight based on the resin.

The resin having a good dyeing affinity and constituting the dye receiving layer may be generally well known and include, for example, polyester, poly(vinyl chloride), acrylic polymer, polyurethane, poly(vinyl acetate) and polyamide resins. Among these resins, homopolymers of vinyl chloride or copolymers containing vinyl chloride as a monomer unit are preferred.

Use of a resin containing a group having an active hydrogen, which is cross-linked with a cross-linking agent such as an isocyanate compound or a melamine resin, could improve heat resistance as well as the release property, of the dye receiving layer.

A di- or tri-isocyanate compound is particularly effective as the isocyanate compound. For example, the isocyanate compound may be 2,4-tolylene diisocyanate, 2,6-tolylene diisocyanate, 4,4'-diphenylmethane diisocyanate, hexamethylene diisocyanate, xylylene diisocyanate, triphenylmethane triisocyanate, isophorone diisocyanate, trimethyl hexamethylene diisocyanate, etc.

The molar ratio of —NCO groups in the isocyanate compound to OH groups in the resin having an active hydrogen is preferably from 0.1:1 to 1:1.

The melamine resin may be, for example, methoxy methyl melamine resin, n-butoxy methyl melamine resin, i-butoxy methyl melamine resin, etc.

The cross-linked resin has preferably a glass transition point equal to or lower than 80° C. so that the dyeing affinity should not be affected, except for a case in which the heat resistance is particularly important.

A catalyst may be used to accelerate the cross-linking reaction. The use of a catalyst enables the cross-linking reaction to be effected at a lower temperature even when such a certain cross-linking agent is used that does not function at ordinary temperature.

An acid, base or metallic compound may be effective as such a curing catalyst. It is preferable to use a tin catalyst in the reaction between a resin having an active hydrogen and an isocyanate compound. The tin catalyst includes dibutyl tin oxide, dioctyl tin oxide, tetrabutyl tin, tin tetrachloride, dibutyl tin laurate, dibutyl tin dilaurate, dioctyl tin dilaurate, butyl tin trichloride, dibutyl tin diacetate, etc.

Preferably, the gel fraction in the dye receiving layer is 70% by weight or more, more preferably 90% by weight or more. The gel fraction of the dye receiving layer of the image receiving sheet is defined as a weight percentage of the insoluble portion of the dye receiving layer based on the initial dye receiving layer when a 50 mm×100 mm image receiving sheet is immersed into 500 g of methyl ethyl ketone for 10 minutes.

The dye receiving layer may further contain 5 to 60% by weight of well-known additives, such as a filler, surfactant, ultraviolet absorbent, antioxidant, fluorescent brightening agent, etc. The filler includes a white inorganic pigment such as silica, titanium oxide or calcium carbonate, and an organic pigment such as fluororesin.

The image receiving sheet for sublimation transfer of the present invention may be prepared by coating a substrate of 4 to 250 μm in thickness with a liquid for forming the dye receiving layer, directly or through a well-known intermediate layer such as an adhesive or heat-insulating layer, followed by drying. The substrate may include wood free paper, synthetic paper, art paper, coated paper, photogravure paper, baryta paper, cellulosic fiber paper or a resin film. The dye receiving layer normally has a thickness of approximately 1 to 20 μm.

When the substrate has an irregular surface, such as a sheet of cellulosic paper, irregularity or unevenness in concentration tends to be caused and, therefore, it is preferable to employ an intermediate layer between the substrate and the dye receiving layer. When an intermediate layer having gaseous bubbles therein is used, there is provided an effective means for improving cushioning and heat-insulating properties. However, in this case, the image receiving sheet tends to vary in size or deform upon heating and, accordingly, it is desirable to further employ a pressure sensitive or elastic adhesive.

A transfer medium for use in combination with the image receiving sheet of the present invention comprises a substrate and a dye layer formed thereon and containing a sublimating dye. In particular, a suitable transfer medium for use in n-fold mode recording has been proposed by Mochizuki et al. in U.S. Pat. No. 4,880,768, which discloses a sublimation type thermosensitive image transfer recording medium comprising: a support; a dye supplying layer formed on said support, comprising a sublimable dye and at least one binder agent in which said sublimable dye is dissolved or dispersed; and an image transfer facilitating layer formed on said dye supplying layer, comprising said sublimable dye and at least one organic binder agent in which said sublimable dye is dissolved or dispersed, said dye supplying layer and said image transfer facilitating layer being constructed in such a manner that (1) the concentration of said sublimable dye in said dye supplying layer is made greater than that of said sublimable dye in said image transfer facilitating layer or (2) the diffusion coefficient of said sublimable dye in said dye supplying layer is greater than that of said sublimable dye in said image transfer facilitating layer.

The present invention will be further illustrated by the following examples. However, the present invention is not limited to these examples. In all of these examples, parts are by weight unless otherwise specified.

EXAMPLE 1

A liquid formulation for forming a dye receiving layer comprised:

- 15 parts of vinyl chloride/vinyl acetate/vinyl alcohol copolymer VAGH, manufactured by Union Carbide Corp.;
- 5 parts of isocyanate compound Colonate L, manufactured by Nippon Polyurethane Corp.;
- 0.5 parts of unmodified silicone oil SH200, kinematic viscosity 1,000 cs, manufactured by Toray Silicone Corp.;
- 0.5 parts of alcohol modified silicone oil SF8427, manufactured by Toray Silicone Corp.;
- 40 parts of toluene; and 40 parts of methyl ethyl ketone.

This liquid formulation was applied onto a foamed PET film W900E, manufactured by Diafoil Corp., and dried. The coated film was heat-treated at 60° C. for 50 hours to prepare an image receiving sheet having a dye receiving layer of 6 μm in thickness.

EXAMPLE 2

The procedures of Example 1 were repeated except that a carboxyl modified silicone oil SF8418, manufactured by Toray Silicone Corp., was substituted for the alcohol modified silicone oil in the liquid formulation for forming a dye receiving layer, to prepare an image receiving sheet.

EXAMPLE 3

The procedures of Example 1 were repeated except that an epoxy modified silicone oil SF8411, manufactured by Toray Silicone Corp., was substituted for the alcohol modified silicone oil in the liquid formulation for forming a dye receiving layer, to prepare an image receiving sheet.

EXAMPLE 4

The procedures of Example 1 were repeated except that an amino modified silicone oil SF8417, manufactured by Toray Silicone Corp., was substituted for the alcohol modified silicone oil in the liquid formulation for forming a dye receiving layer, to prepare an image receiving sheet.

EXAMPLE 5

The procedures of Example 1 were repeated except that the amounts of the silicone oils of both types were each 2.0 parts by weight in the liquid formulation for forming a dye receiving layer, to prepare an image receiving sheet.

EXAMPLE 6

The procedures of Example 1 were repeated except that the amounts of the silicone oils of both types were each 0.05 parts by weight in the liquid formulation for forming a dye receiving layer, to prepare an image receiving sheet.

EXAMPLE 7

The procedures of Example 1 were repeated except that 0.1 part of a tin catalyst TK1L, manufactured by Takeda Chemical Industries, Ltd., was added to the liquid formulation for forming a dye receiving layer, to prepare an image receiving sheet.

EXAMPLE 8

The procedures of Example 1 were repeated except that the heat-treatment was effected at 120° C. for 2 hours, to prepare an image receiving sheet.

COMPARATIVE EXAMPLE 1

The procedures of Example 1 were repeated except that the liquid formulation for forming a dye receiving layer was free from alcohol modified silicone oil but contained 1.0 part by weight of the unmodified silicone oil, to prepare an image receiving sheet.

COMPARATIVE EXAMPLE 2

The procedures of Example 1 were repeated except that the liquid formulation for forming a dye receiving layer was free from unmodified silicone oil but contained 1.0 part by weight of the alcohol modified silicone oil, to prepare an image receiving sheet.

COMPARATIVE EXAMPLE 3

The procedures of Example 1 were repeated except that an epoxy modified silicone oil SF8411, manufactured by Toray Silicone Corp., was substituted for the unmodified silicone oil in the liquid formulation for forming a dye receiving layer, to prepare an image receiving sheet.

COMPARATIVE EXAMPLE 4

The procedures of Example 1 were repeated except that an amino modified silicone oil SF8417, manufactured by Toray Silicone Corp., and an epoxy modified silicone oil SF8411, manufactured by Toray Silicone Corp., were substituted for the unmodified silicone oil and the alcohol modified silicone oil, respectively, in the liquid formulation for forming a dye receiving layer, to prepare an image receiving sheet.

EVALUATING TEST

A transfer medium was prepared by applying a formulation for forming an intermediate adhesive layer on an aromatic polyamide film of 6 μm in thickness having a silicone resin heat-resistant layer of 1 μm in thickness by means of a wire bar, drying at 120° C. for 1.5 minutes and aging at 60° C. for 24 hours to form an intermediate adhesive layer of 1.0 μm in thickness, then forming a dye supply layer, a dye transfer layer and a low dyeing slip layer of 3 μm, 1 μm and 0.7 μm in coating thickness, respectively, followed by drying at 100° C. for 1.5 minutes and aging at 60° C. for 24 hours.

The formulations for forming the intermediate adhesive, dye supply, dye transfer and low dyeing slip layers had the following compositions.

Intermediate Adhesive Layer 10 parts of polyvinyl butyral resin BX-1, manufactured by Sekisui Chemical Co., Ltd.;

10 parts of diisocyanate Colonate L, manufactured by Nippon Polyurethane Corp.;

95 parts of toluene; and 95 parts of methyl ethyl ketone.

Dye Supply Layer 10 parts of polyvinyl butyral resin BX-1;

5 parts of diisocyanate Colonate L;

30 parts of sublimating dye HSO-144, manufactured by Mitsui Toatsu Dye Chemicals, Inc.;

180 parts of ethanol; and 10 parts of n-butanol.

Dye Transfer Layer 10 parts of polyvinyl butyral resin BX-1;

5 parts of diisocyanate Colonate L;

12 parts of sublimating dye HSO-144;

95 parts of toluene; and 95 parts of methyl ethyl ketone.

Low Dyeing Slip Layer 5 parts of styrene-maleic acid copolymer Suprapal AP30 manufactured by BASF;

12 parts of Liquid A; and 20 parts of tetrahydrofuran.

The Liquid A was prepared by dissolving 15 g dimethyl methoxy silane and 9 g methyl trimethoxy silane in a mixture of 12 g toluene and 12 g methyl ethyl ketone and hydrolyzing with addition of 13 ml of 3% sulfuric acid for 3 hours.

Recording Test Conditions and Results

The transfer medium and the image receiving sheet were superimposed with each other such that the dye layer of the transfer medium was brought into contact with the dye receiving layer of the image receiving sheet. A recording test was conducted under the following conditions:

| | |
|---|---|
| Maximum applied energy | 2.21 mJ/dot; |
| Running speed of the image receiving sheet | 8.4 mm/sec; and |
| Running speed of the transfer medium | 0.6 mm/sec. |

Image density was measured by Macbeth type RD-918, manufactured by Macbeth Co.

The test results are shown in the following Table.

TABLE

| Image receiving sheet | Low image density region | | High image density region | |
|---|---|---|---|---|
| | Image density | Image quality | Image density | Image quality |
| Ex. 1 | 0.57 | b | 2.41 | A |
| Ex. 2 | 0.51 | b | 2.30 | B |
| Ex. 3 | 0.53 | b | 2.32 | B |
| Ex. 4 | 0.57 | b | 2.40 | C |
| Ex. 5 | 0.58 | b | 2.42 | A |
| Ex. 6 | 0.51 | b | 2.31 | C |
| Ex. 7 | 0.51 | a | 2.35 | A |
| Ex. 8 | 0.40 | a | 1.87 | A |
| Comp. Ex. 1 | 0.51 | c | — | E |
| Comp. Ex. 2 | 0.54 | c | — | D |
| Comp. Ex. 3 | 0.52 | c | 2.35 | A |
| Comp. Ex. 4 | 0.49 | c | 2.31 | B |

Note:

All samples except Examples 7 and 8 had a gel fraction in the image receiving layer of 70%. The gel fractions in Examples 7 and 8 were 95% and 100%, respectively.

In the column of quality of printed image in the low image density region, the small letters a, b and c mean "good", "slight irregularity in image density" and "irregularities in image density due to sticking", respectively.

In the column of quality of printed image in the high image density region, the capital letters A, B, C, D and E mean "good", "slight irregularity in gloss", "slight irregularity in density", "spot-like fusion" and "peeling of ink layer due to fusion", respectively.

From the results shown in the above Table, it should be understood that the image receiving sheet of the present invention as an image receptor has a high release property with respect to an ink sheet so that a good thermal transfer recorded image is obtained.

The image receiving sheet for sublimation transfer according to the present invention has an excellent release property by adding a mixture of unmodified and modified silicone oils into a dye receiving layer. This image receiving sheet can be applied to a so-called n-fold mode differential recording process for recording an image while a difference between running speeds of the image receiving sheet and transfer medium is provided. In this case, no fusion or sticking is caused between the image receiving sheet and the transfer medium.

Many widely different embodiments of the present invention may be constructed without departing from the spirit and scope of the present invention. It should be understood that the present invention is not limited to the specific embodiments described in the specification, except as defined in the appended claims.

What is claimed is:

1. A thermal transfer recording process, comprising the steps of:

a) superimposing an image recording medium composed of a sublimating dye on an image receiving sheet; and b) applying heat imagewise to the image recording medium to transfer an image from the image recording medium to the image receiving sheet, wherein the running speed of the image receiving sheet is n-times (n>1) as large as that of the image recording medium, and wherein the image receiving sheet comprises a substrate and a dye receiving layer containing an unmodified silicone oil, a modified silicone oil, and a resin.

2. The process of claim 1, wherein the running speed of the image receiving sheet is n-times (n>10) as large as that of the image recording medium.

3. The process of claim 1, wherein the unmodified silicone oil is selected from the group consisting of dimethyl silicone oil, methyl phenyl silicone oil and methyl hydrogen silicone oil.

4. The process of claim 1, wherein the modified silicone oil is modified with a modifier selected from the group consisting of alcohol, polyether, carboxyl and epoxy compounds.

5. The process of claim 1, wherein the weight ratio of the unmodified silicone oil to the modified silicone oil is in the range of 0.05:0.95 to 0.95:0.05.

6. The process of claim 1, wherein the weight ratio of the unmodified silicone oil to the modified silicone oil is in the range of 0.20:0.80.

7. The process of claim 1, wherein the total amount of the unmodified and modified silicone oils is in the range of 2 to 15% by weight based on the amount of resin in the dye receiving layer.

8. The process of claim 1, wherein the resin is selected from the group consisting of polyester, poly(vinyl chloride), acrylic polymer, polyurethane, poly(vinyl acetate) and polyamide.

9. The process of claim 1, wherein the resin is a homopolymer of vinyl chloride or a copolymer of vinyl chloride.

10. The process of claim 1, wherein the resin is crosslinked with an isocyanate compound or melamine resin through a group having an active hydrogen therein.

11. The process of claim 10, wherein the cross-linked resin has a glass transition temperature of 80° C. or lower.

12. The process of claim 1, wherein the dye receiving layer has a gel fraction of 70% by weight of more.

13. The process of claim 1, wherein the gel fraction of the dye receiving layer is 90% by weight or more.

14. The process of claim 1, wherein the dye receiving layer has a thickness of 1 to 20 μm.

15. The process of claim 10, wherein an intermediate layer is interposed between the dye receiving layer and the substrate.

* * * * *